US005385400A

United States Patent [19]

Chen

[11] Patent Number: 5,385,400

[45] Date of Patent: Jan. 31, 1995

[54] EXPANSIBLE TOOL CABINET

[75] Inventor: Chang Chen, Taichung Hsien, Taiwan, Prov. of China

[73] Assignee: Tung I Enterprise Co., Ltd., Taiwan, Prov. of China

[21] Appl. No.: 119,811

[22] Filed: Sep. 10, 1993

[51] Int. Cl.[6] ..... A47B 45/00

[52] U.S. Cl. ..... 312/205; 220/8; 312/107

[58] Field of Search ..... 312/330.1, 107, 111, 312/205, 297; 220/8, 4.03, 693, 720

[56] References Cited

U.S. PATENT DOCUMENTS

| | | | |
|---|---|---|---|
| 1,730,069 | 10/1929 | Gebser | 220/8 |
| 2,253,475 | 8/1941 | Willber | 312/205 |
| 2,573,602 | 10/1951 | Regenhardt | 312/111 |
| 2,589,319 | 3/1952 | Albrecht | 312/205 |
| 3,887,102 | 6/1975 | Earley | 220/8 |
| 4,102,275 | 7/1978 | Spound et al. | 312/205 |
| 4,390,217 | 6/1983 | Washer | 312/205 |
| 4,634,193 | 1/1987 | Liu | 312/107 |
| 5,007,550 | 4/1991 | Avot | 220/8 |

*Primary Examiner*—Kenneth J. Dorner
*Assistant Examiner*—Janet M. Wilkens
*Attorney, Agent, or Firm*—Baker & Botts

[57] ABSTRACT

An expansible tool cabinet includes a stationary outer housing which has two opposed vertical side walls that are formed with a plurality of spaced projections on the inner wall surfaces of the side walls. The projections cooperatively define a plurality of vertical slide ways and longitudinal slide ways thereamong. A slidable inner housing has a horizontal top wall which has two opposite longitudinal edges that are formed with a plurality of spaced downwardly extending guiding strips. Each of the strips has a plurality of spaced protrusions protruding inwardly therefrom. The protrusions cooperatively define a plurality of longitudinal slide ways thereamong. The inner housing is disposed slidably in the outer housing and is movable between a first position, wherein each of the longitudinal slide ways of the outer housing overlaps with a corresponding one of the longitudinal slide ways defined by the protrusions, drawers being removably received in the overlapping longitudinal slide ways of the outer and inner housings, and a second position, wherein the drawers are removably and selectively received in the longitudinal slide ways of the outer housing and the longitudinal slide ways of the inner housing. A retaining unit is provided on the outer housing and is operable to retain selectively the inner housing in one of the first and second positions.

5 Claims, 5 Drawing Sheets

EXPANSIBLE TOOL CABINET

BACKGROUND OF THE INVENTION

1. Field of the Invention

This invention relates to a tool cabinet, more particularly to an expansible tool cabinet.

2. Description of the Related Art

Presently, the volume of a conventional tool cabinet is fixed. Therefore, if the tools are too many for storage in one conventional tool cabinet, the excess tools must be stored in another conventional tool cabinet. It is inconvenient to use and carry two tool cabinets at the same time. On the other hand, if the conventional tool cabinet is too large to receive the tools, it is impractical to carry a tool cabinet which has a lot of unoccupied tool receiving spaces.

SUMMARY OF THE INVENTION

Therefore, the main object of the present invention is to provide an expansible tool cabinet which is variable in volume so as to facilitate storage and transport of a number of tools.

According to this invention, an expansible tool cabinet includes a plurality of tool receiving drawers, a stationary outer housing, a slidable inner housing and a retaining unit. The stationary outer housing has two opposed vertical side walls. Each of the side walls has an inner wall surface that is formed with a plurality of vertically and horizontally spaced projections. The projections cooperatively define a plurality of vertical slide ways and longitudinal slide ways thereamong. The outer housing further has an open front side to access the longitudinal slide ways. The slidable inner housing has a horizontal top wall which has two opposite longitudinal edges. Each of the longitudinal edges is formed with a plurality of spaced downwardly extending guiding strips. Each of the strips has a plurality of spaced protrusions that protrude inwardly therefrom. The protrusions cooperatively define a plurality of longitudinal slide ways thereamong. The inner housing further has an open front side to access the longitudinal slide ways. The inner housing is disposed slidably in the outer housing and is movable between a first position, wherein each of the guiding strips is received in a corresponding one of the vertical slide ways of the outer housing and each of the longitudinal slide ways of the outer housing overlaps with a corresponding one of the longitudinal slide ways defined by the protrusions, the drawers being removably received in the overlapping longitudinal slide ways of the outer and inner housings via the open front side of the outer housing, and a second position, wherein the inner housing is above the outer housing and the drawers are removably and selectively received in the longitudinal slide ways of the outer housing and the longitudinal slide ways of the inner housing via the open front sides of the inner and outer housing. The retaining unit is provided on the outer housing and is operable to retain selectively the inner housing in one of the first and second positions.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
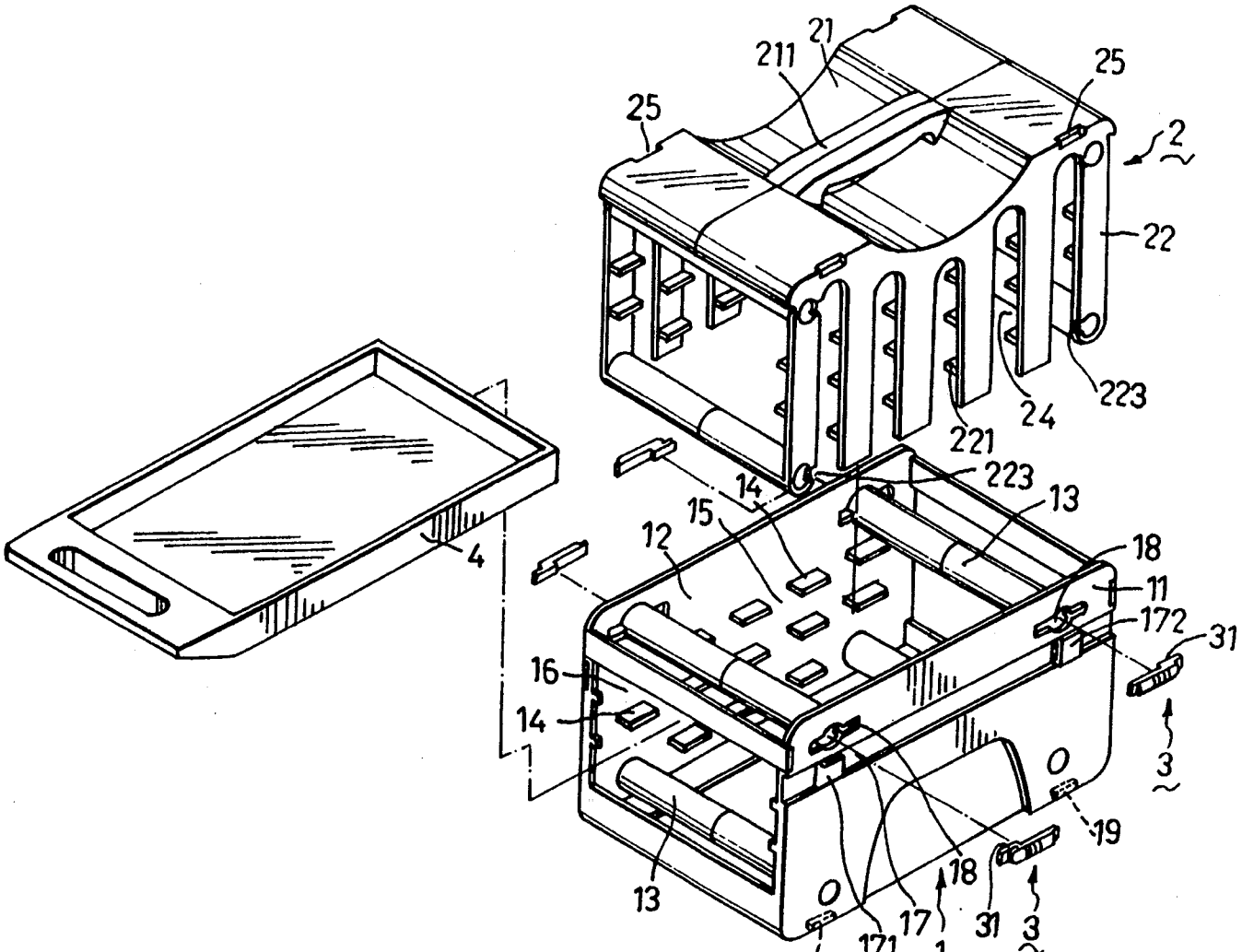
FIG. 1 is an exploded view of an expansible tool cabinet according to the present invention.
Figure 2:
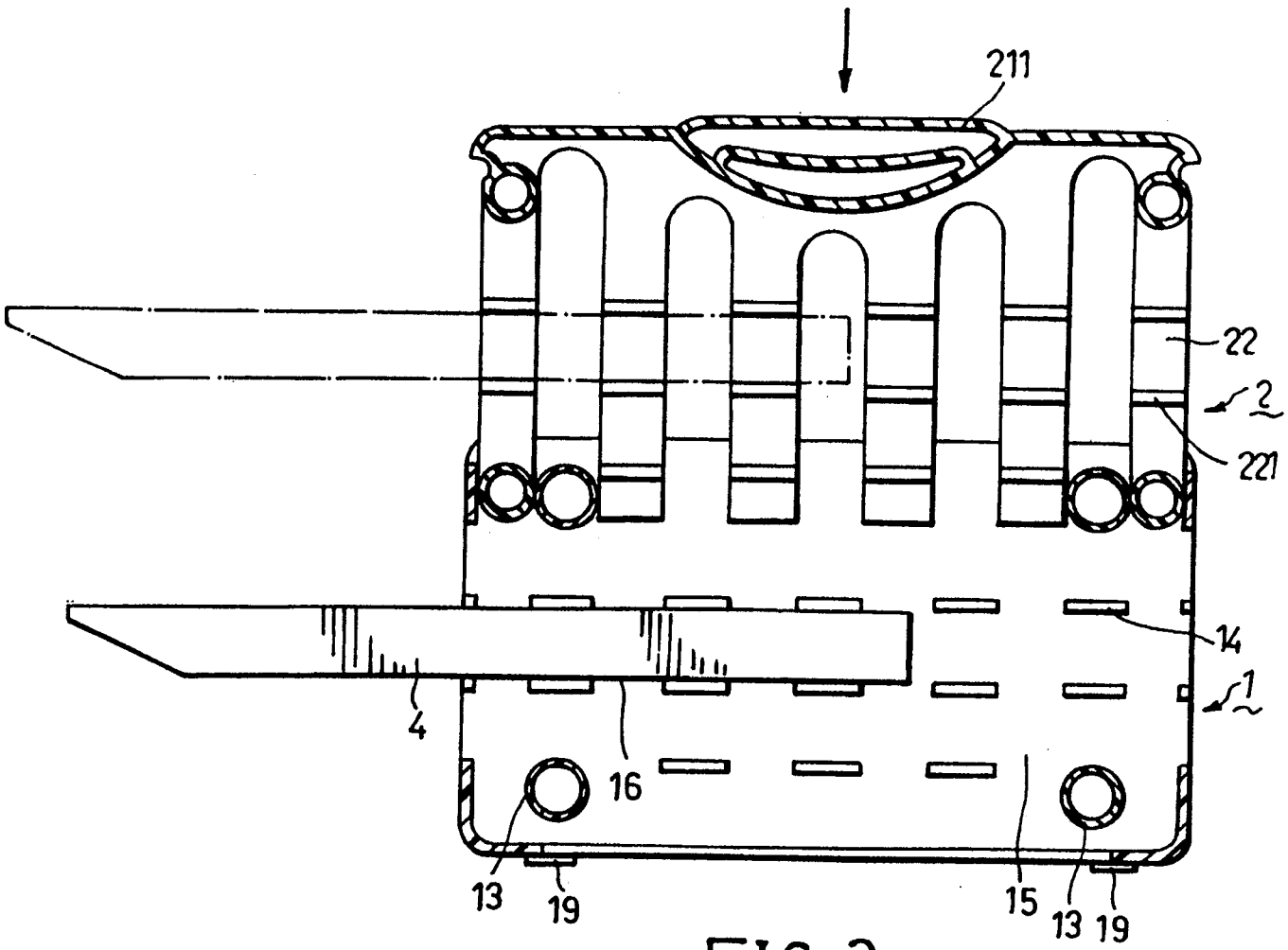
FIG. 2 is a sectional view of the expansible tool cabinet according to the present invention when the slidable inner housing is in the second position.

Referring to FIGS. 1 and 2, an expansible tool cabinet according to this invention includes a stationary outer housing 1, a slidable inner housing 2, a retaining unit and a plurality of tool receiving drawers 4.

The stationary outer housing 1 has two opposed vertical side walls 11, 12. The side walls 11, 12 are spaced apart by a plurality of connecting rods 13 that extend between the inner wall surfaces thereof. The inner wall surface of each of the side walls 11, 12 is formed with a plurality of vertically and horizontally spaced projections 14. The projections 14 cooperatively define a plurality of vertical slide ways 15 and longitudinal slide ways 16 thereamong. Each of the side walls 11, 12 of the outer housing 1 has an outer wall surface that is formed with a longitudinal groove 17. A hook 171 and a socket 172 are provided on the outer wall surface of each of the side walls 11, 12 in the longitudinal groove 17. The groove, the hook and the socket in the outer wall surface of the side wall 12 are not shown. The locations and the orientations of the hook and the socket in the outer wall surface of the side wall 12 are opposite to those of the hook 171 and the socket 172 on the outer wall surface of the side wall 11. The outer housing 1 further has a bottom wall formed with four leg members 19, and an open front side to access the longitudinal slide ways 16. Each of the side walls of the outer housing 1 further has an upper portion formed with two horizontally aligned slots 18.

The slidable inner housing 2 has a horizontal top wall which has two opposite longitudinal edges. Each of the longitudinal edges is formed with a plurality of spaced downwardly extending guiding strips 22. Each of the strips 22 has a plurality of spaced protrusions 221 that protrude inwardly therefrom. The protrusions 221 cooperatively define a plurality of longitudinal slide ways 24 thereamong. The inner housing further has an open front side to access the longitudinal slide ways 24. The inner housing 2 is disposed slidably in the outer housing 1 and is movable between a first position, wherein each of the guiding strips 22 is received in a corresponding one of the vertical slide ways 15 of the outer housing 1 and each of the longitudinal slide ways 16 of the outer housing 1 overlaps with a corresponding one of the longitudinal slide ways 24 defined by the protrusions 221, the drawers 4 being removably received in the overlapping longitudinal slide ways 16, 24 of the outer and inner housings 1, 2 via the open front side of the outer housing 1, and a second position, wherein the inner housing 2 is above the outer housing 1 and the drawers 4 are removably and selectively received in the longitudinal slide ways 16 of the outer housing 1 and the longitudinal slide ways 24 of the inner housing 2 via the open front sides of the inner and outer housing 1, 2. The guiding strips 22 form side walls on two sides of the inner housing 2. Each of the side walls of the inner housing 2 has an upper portion and a lower portion. Each of the upper and lower portions is formed with two horizontally aligned retaining notches 223. The top wall of the inner housing 2 is formed with four positioning grooves 25. Two of the positioning grooves 25 are adjacent to one of the longitudinal edges of the top wall of the inner housing 2, while the other two of the positioning grooves 25 are adjacent to another one of the longitudinal edges of the top wall of the inner housing. The top wall of the inner housing 2 has a top surface formed with an indented portion 21. A handle 211 is formed in the indented portion 21.

The retaining unit is provided on the outer housing 1 and is operable to retain selectively the inner housing 2 in one of the first and second positions. The retaining unit includes four elongated positioning members 3 that engage slidably a corresponding one of the slots 18. Each of the positioning members 3 has a locking protuberance 31 which is formed at one end thereof and which engages selectively one of the notches 223 in one of the upper and lower portions of the side walls of the inner housing 2 to retain selectively the inner housing 2 in one of the first and second positions.

In assembly, the inner housing 2 is fully disposed in the outer housing 1. The locking protuberance 31 of each of the positioning members 3 engages a corresponding one of the notches 223 in the upper portions of the side walls of the inner housing 2 so as to retain the inner housing 2 in the first position. Thus, the drawers 4 are removably received in the overlapping longitudinal slide ways 16, 24 of the outer and inner housings 1, 2. The tool cabinet of the present invention can be carried by handling the handle 211.

Figure 3:
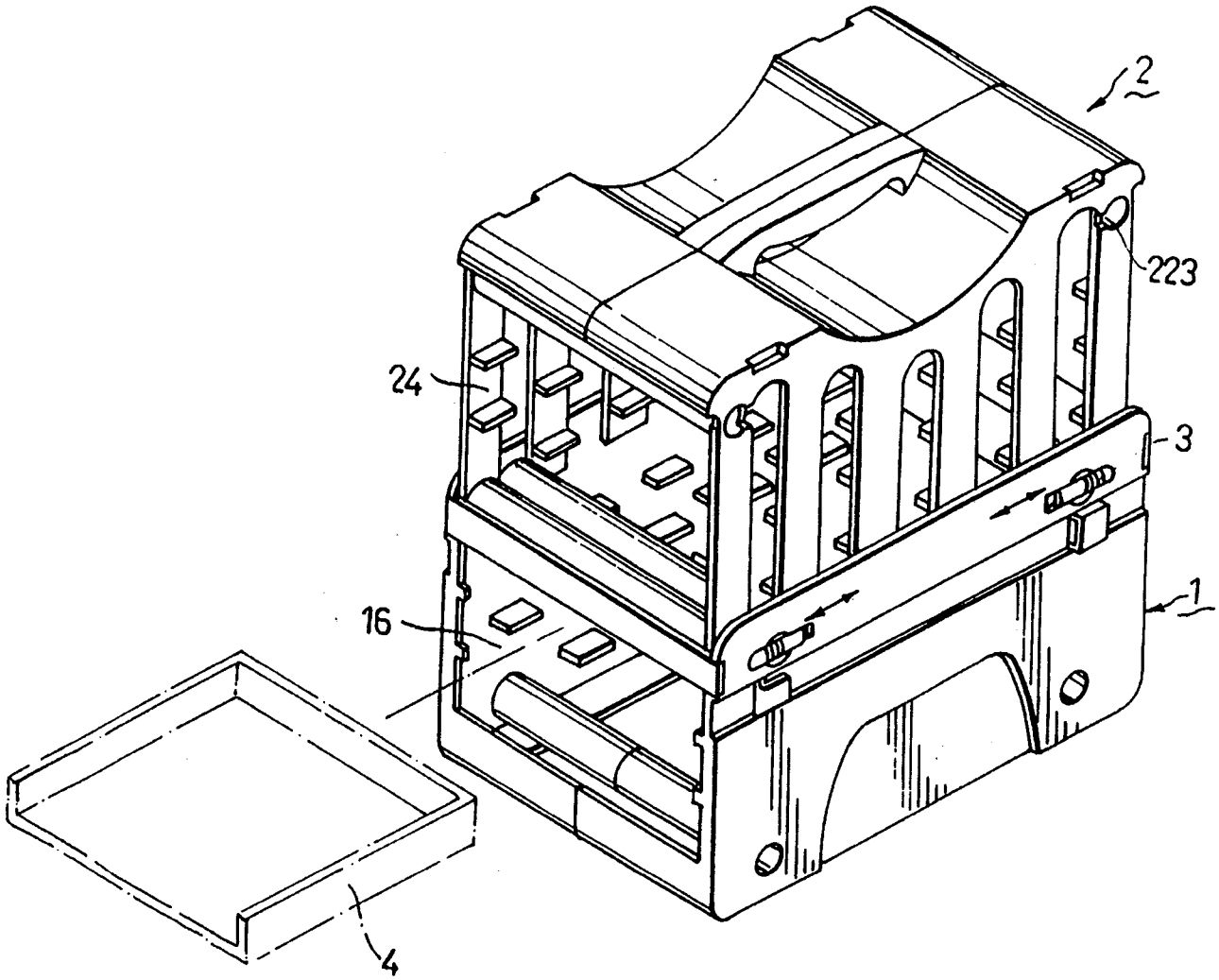
FIG. 3 is a perspective view showing the expansible tool cabinet according to the present invention when the slidable inner housing is in the second position.

Referring now to FIG. 3, when the tool cabinet of the present invention is intended to increase the volume so as to receive more drawers 4, the drawers 4, which are originally received in the overlapping longitudinal slide ways 16, 24 of the outer and inner housing 1, 2, are removed. The locking protuberance 31 of each of the positioning members 3 disengages the corresponding one of the notches 223 in the upper portions of the side walls of the inner housing 2 so as to permit the inner housing 2 to move from the first position to the second position. The locking protuberance 31 of each of the positioning members 3 then engages a corresponding one of the notches 223 in the lower portions of the side walls of the inner housing 2 so as to retain the inner housing 2 in the second position. At this stage, each of the longitudinal slide ways 16 of the outer housing 1 and each of the longitudinal slide ways 24 of the inner housing 2 can respectively receive one drawer 4 therein so that the volume for receiving tools is increased.

Figure 4:
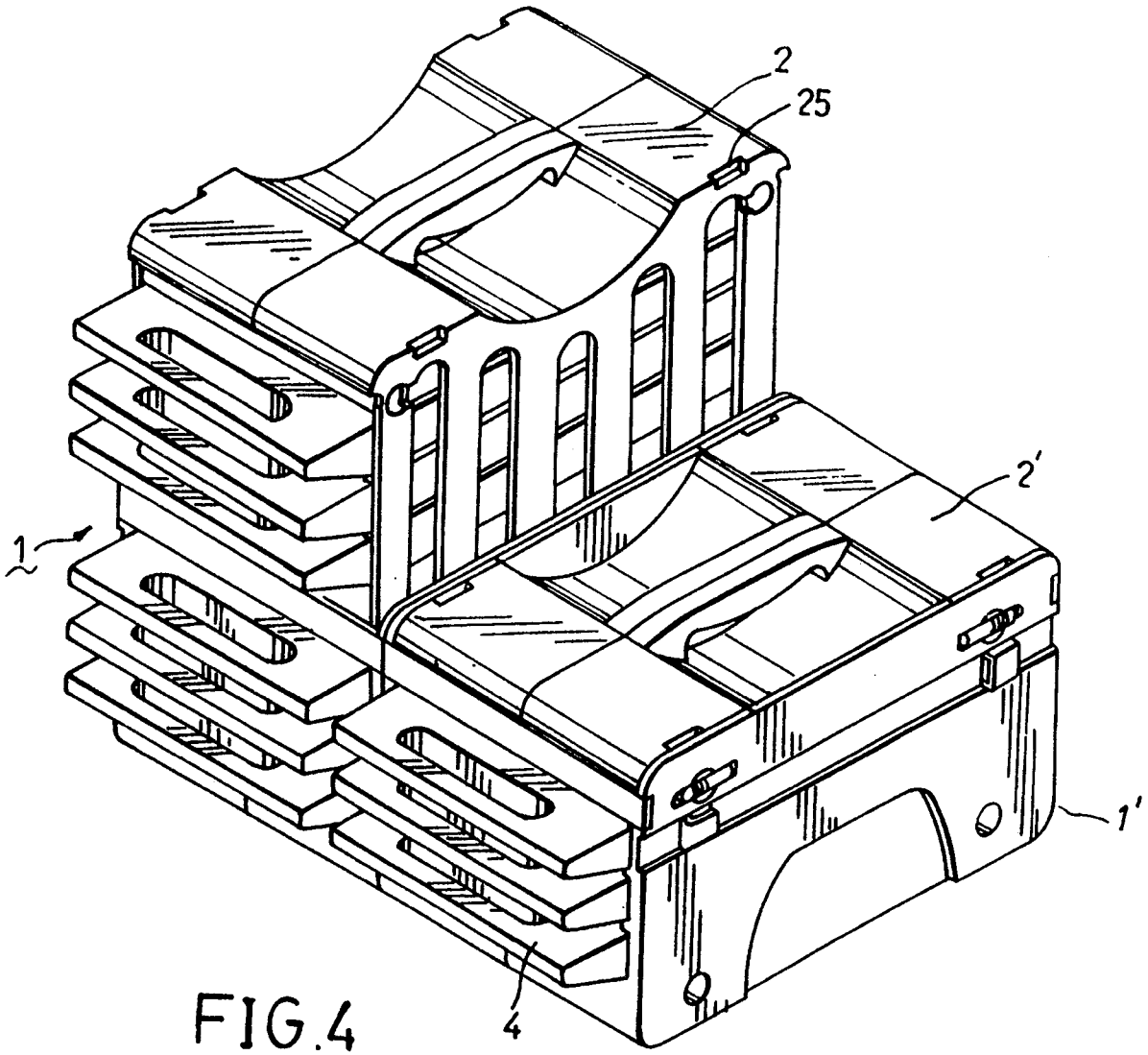
FIG. 4 is a perspective view illustrating the incorporation of two expansible tool cabinet according to the present invention.
Figure 5:
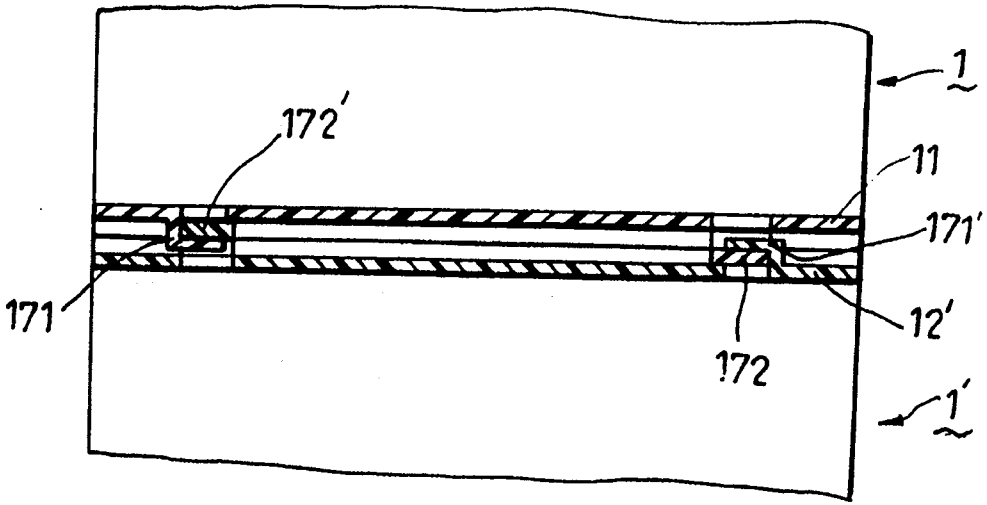
FIG. 5 is a schematic sectional view showing the connection between two expansible tool cabinets which are placed side by side.

To further increase the volume for receiving tools, another tool cabinet 1' is incorporated by connecting the hooks 171, 171' and the sockets 172,172' of the outer housings 1, 1', as illustrated in FIGS. 4 and 5. The hook 171 on the outer wall surface of the side wall 11 of the outer housing 1 engages the socket 172' on the outer wall surface of the side wall 12' of the outer housing 1' while the hook 171' on the outer wall surface of the side wall 12' of the outer housing 1' engages the socket 172 on the outer wall surface of the side wall 11 of the outer housing 1. Furthermore, a tool cabinet of the present invention can be piled on top of another tool cabinet of the present invention such that each of the leg members of said tool cabinet engages a corresponding one of the positioning grooves of said another tool cabinet (not shown).

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An expansible tool cabinet, comprising:

a plurality of tool receiving drawers;

a stationary outer housing having two opposed vertical side walls, each of said side walls having an inner wall surface formed with a plurality of vertically and horizontally spaced projections, said projections cooperatively defining a plurality of vertical slide ways and longitudinal slide ways thereamong, said outer housing further having an open front side to access said longitudinal slide ways;

a slidable inner housing having a horizontal top wall which has two opposite longitudinal edges, each of said longitudinal edges being formed with a plurality of spaced downwardly extending guiding strips, each of said strips having a plurality of spaced protrusions protruding inwardly therefrom, said protrusions cooperatively defining a plurality of longitudinal slide ways thereamong, said inner housing further having an open front side to access said longitudinal slide ways, said inner housing being disposed slidably in said outer housing and being movable between a first position, wherein each of said guiding strips is received in a corresponding one of said vertical slide ways of said outer housing and each of said longitudinal slide ways of said outer housing overlaps with a corresponding one of said longitudinal slide ways defined by said protrusions, said drawers being removably received in overlapping said longitudinal slide ways of said outer and inner housings via said open front side of said outer housing, and a second position, wherein said inner housing is above said outer housing and said drawers are removably and selectively received in said longitudinal slide ways of said outer housing and said longitudinal slide ways of said inner housing via said open front sides of said inner and outer housings; and a retaining unit provided on said outer housing and operable to retain selectively said inner housing in one of said first and second positions.

2. An expansible tool cabinet as claimed in claim 1, wherein said guiding strips form side walls on two sides of said inner housing, each of said side walls of said inner housing having an upper portion and a lower portion, each of said upper and lower portions being formed with two horizontally aligned retaining notches, each of said side walls of said outer housing further having an upper portion formed with two horizontally aligned slots, said retaining unit including four elongated positioning members engaging slidably a corresponding one of said slots, each of said positioning members having a locking protuberance which is formed at one end thereof and which engages selectively one of said notches in one of said upper and lower portions of said side walls of said inner housing to retain selectively said inner housing in one of said first and second positions.

3. An expansible tool cabinet as claimed in claim 1, wherein each of said side walls of said outer housing has an outer wall surface formed with a longitudinal groove, and a hook and a socket provided on said outer wall surface in said longitudinal groove, said hook on each of said side walls of said outer housing being capable of engaging said socket of said outer housing of another said expansible tool cabinet, said socket on each of said side walls of said outer housing being capable of engaging said hook of said outer housing of said another expansible tool cabinet.

4. An expansible tool cabinet as claimed in claim 1, wherein said outer housing has a bottom wall which is formed with a plurality of leg members, and said top wall of said inner housing is formed with a plurality of positioning grooves for receiving said leg members of said outer housing of another said expansible tool cabinet.

5. An expansible tool cabinet as claimed in claim 1, wherein said top wall of said inner housing has a top surface formed with an indented portion, and a handle formed in said indented portion.

* * * * *